US008881819B2

(12) United States Patent
Crow et al.

(10) Patent No.: US 8,881,819 B2
(45) **Date of Patent: *Nov. 11, 2014**

(54) TUBULAR CUTTING WITH A SEALED ANNULAR SPACE AND FLUID FLOW FOR CUTTINGS REMOVAL

(75) Inventors: Stephen L. Crow, Kingwood, TX (US); Marcelle H. Hedrick, Kingwood, TX (US); Erik V. Nordenstam, The Woodlands, TX (US); Christopher W. Guidry, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 491 days.

This patent is subject to a terminal disclaimer.

(21) Appl. No.: 13/108,374

(22) Filed: May 16, 2011

(65) Prior Publication Data

US 2012/0292028 A1 Nov. 22, 2012

(51) Int. Cl.

| | |
|---|---|
| ***E21B 29/00*** | (2006.01) |
| ***E21B 27/00*** | (2006.01) |
| ***E21B 23/01*** | (2006.01) |

(52) U.S. Cl.

CPC ..... *E21B 29/005* (2013.01); *E21B 27/00* (2013.01); *E21B 23/01* (2013.01)

USPC ..... 166/298; 166/55.7

(58) Field of Classification Search

USPC ..... 166/55.7, 298

See application file for complete search history.

(56) References Cited

U.S. PATENT DOCUMENTS

| | | | | |
|---|---|---|---|---|
| 1,638,494 | A * | 8/1927 | Lewis et al. | 294/86.15 |
| 1,867,289 | A | 7/1932 | Ventresca | |
| 2,203,011 | A | 6/1940 | Ellis et al. | |
| 2,899,000 | A | 8/1959 | Medders et al. | |
| 2,991,834 | A | 7/1961 | Kennard | |
| 3,399,729 | A * | 9/1968 | McGill | 166/120 |

(Continued)

FOREIGN PATENT DOCUMENTS

| | | | |
|---|---|---|---|
| WO | 9205336 | A1 | 4/1992 |
| WO | 03101656 | A1 | 12/2003 |
| WO | 2011031164 | A1 | 3/2011 |

OTHER PUBLICATIONS

Excerpt—Baker-Hughes Catalog "Wellbore Intervention", Copyright 2010.*

(Continued)

*Primary Examiner* — Shane Bomar
*Assistant Examiner* — George Gray
(74) *Attorney, Agent, or Firm* — Steve Rosenblatt

(57) ABSTRACT

A cut and pull spear is configured to obtain multiple grips in a tubular to be cut under tension. The slips are set mechanically with the aid of drag blocks to hold a portion of the assembly while a mandrel is manipulated. An annular seal is set in conjunction with the slips to provide well control during the cut. An internal bypass around the seal can be in the open position to allow circulation during the cut. The bypass can be closed to control a well kick with mechanical manipulation as the seal remains set. If the tubular will not release after an initial cut, the spear can be triggered to release and be reset at another location. The mandrel is open to circulation while the slips and seal are set and the cut is being made. Cuttings are filtered before entering the bypass to keep the cuttings out of the blowout preventers.

23 Claims, 4 Drawing Sheets

(56) References Cited

U.S. PATENT DOCUMENTS

| | | | | |
|---|---|---|---|---|
| 4,047,568 | A | 9/1977 | Aulenbacher | |
| 4,071,084 | A * | 1/1978 | Brown et al. | 166/129 |
| 4,709,758 | A * | 12/1987 | Preston, Jr. | 166/120 |
| 4,969,514 | A | 11/1990 | Morris et al. | |
| 5,086,839 | A * | 2/1992 | Setterberg et al. | 166/138 |
| 5,101,895 | A | 4/1992 | Gilbert | |
| 5,253,710 | A | 10/1993 | Carter et al. | |
| 6,176,311 | B1 | 1/2001 | Ryan | |
| 6,276,452 | B1 | 8/2001 | Davis et al. | |
| 6,357,528 | B1 | 3/2002 | Davis et al. | |
| 6,607,031 | B2 | 8/2003 | Lynde et al. | |
| 6,655,461 | B2 * | 12/2003 | Eslinger et al. | 166/305.1 |
| 7,562,700 | B2 | 7/2009 | Lewis et al. | |
| 7,610,957 | B2 | 11/2009 | Davis et al. | |
| 7,762,330 | B2 | 7/2010 | Saylor, III et al. | |
| 7,779,901 | B2 | 8/2010 | Davis et al. | |
| 2005/0077046 | A1 | 4/2005 | Simpson et al. | |
| 2005/0126775 | A1 * | 6/2005 | Van Nguy et al. | 166/125 |
| 2006/0196679 | A1 | 9/2006 | Brisco et al. | |
| 2007/0131410 | A1 | 6/2007 | Hill et al. | |
| 2010/0288491 | A1 | 11/2010 | Cochran et al. | |

OTHER PUBLICATIONS

Baker Hughes technical information, Baker Oil Tools, Convention Fishing Technical Unit, "Casing and Tubing Spear Packoff Assembly", Oct. 2003, 1-8.

* cited by examiner

TUBULAR CUTTING WITH A SEALED ANNULAR SPACE AND FLUID FLOW FOR CUTTINGS REMOVAL

FIELD OF THE INVENTION

The field of the invention is tubular cutters that grip before the cut to put the string in tension and more particularly a resettable tool with the ability to isolate the tubular with a seal by closing a seal bypass while leaving the bypass open for circulation as the tubular is cut.

BACKGROUND OF THE INVENTION

When cutting and removing casing or tubulars, a rotary cutter is employed that is driven from the surface or downhole with a downhole motor. The cutting operation generates some debris and requires circulation of fluid for cooling and to a lesser extent debris removal purposes. One way to accommodate the need for circulation is to avoid sealing the tubular above the cutter as the cut is being made. In these cases also the tubular being cut can be in compression due to its own weight. Having the tubing in compression is not desirable as it can impede the cutting process making blade rotation more difficult as the cut progresses. Not actuating a seal until the cut is made as shown in U.S. Pat. No. 5,101,895 in order to allow for circulation during the cut leaves the well open so that if a kick occurs during the tubing cutting it becomes difficult to quickly get control of the well. Not gripping the cut casing until the cut is made so that the cut is made with the tubular in compression is shown in U.S. Pat. No. 6,357,528. In that tool there is circulation through the tool during cutting followed by dropping an object into the tool that allows the tool to be pressured up so that the spear can be set after the cut is made.

Sometimes the casing or tubular is cut in a region where it is cemented so that the portion above the cut cannot be removed. In these situations another cut has to be made further up the casing or tubular. Some known designs are set to engage for support with body lock rings so that there is but a single opportunity to deploy the tool in one trip. In the event the casing or tubular will not release, these tools have to be pulled from the wellbore and redressed for another trip.

While it is advantageous to have the opportunity for well control in the event of a kick the setting of a tubular isolator has in the past presented the associated problem of blocking fluid circulation as the cut is being made.

Another approach to making multiple cuts is to have multiple assemblies at predetermined spacing so that different cutters can be sequentially deployed. This design is shown in U.S. Pat. No. 7,762,330. It has the ability to sequentially cut and then grip two cut pieces of a tubular in a single trip and then remove the cut segments together.

U.S. Pat. No. 5,253,710 illustrates a hydraulically actuated grapple that puts the tubular to be cut in tension so that the cut can be made. U.S. Pat. No. 4,047,568 shows gripping the tubular after the cut. Neither of the prior two references provide any well control capability.

Some designs set an inflatable packer but only after the cut is made so that there is no well control as the cut is undertaken. Other designs are limited by being settable only one time so that if the casing will not release where cut, making another cut requires a trip out of the well. Some designs set a packer against the stuck portion of the tubular as the resistive force which puts the tubular being cut in compression and makes cutting more difficult. Some designs use a stop ring which requires advance spacing of the cutter blades to the stop ring. In essence the stop ring is stopped by the top of a fish so that if the fish will not release when cut in that one location, the tool has to be tripped out and reconfigured for a cut at a different location.

The latter design is illustrated in FIG. 1. The cutter that is not shown is attached at thread 10 to rotating hub 12. Mandrel 14 connects drive hub 16 to the rotating hub 12. Stop ring 18 stops forward travel when it lands on the top of the fish that is also not shown. When that happens weight is set down to engage castellations 20 with castellations 22 to drive a cam assembly 24 so that a stop to travel of the cone 26 with respect to slips 28 can be moved out of the way so that a subsequent pickup force will allow the cone 26 to go under the slips 28 and grab the fish and hold it in tension while the cut is made. Again, the cut location is always at a single fixed distance to the location of the stop ring 18.

Some designs allow a grip in the tubular to pull tension without the use of a stop ring but they can only be set one time at one location. Some examples are U.S. Pat. Nos. 1,867,289; 2,203,011 and 2,991,834. U.S. Pat. No. 2,899,000 illustrates a multiple row cutter that is hydraulically actuated while leaving open the mandrel for circulation during cutting.

What is needed and provided by the present invention is the ability to make multiple cuts in a single trip while providing a spear that mechanically is set to grab inside the tubular being cut above the cut location. Additionally the packer can be already deployed before the cut is started to provide well control while also providing a bypass to allow circulation through the tool while cutting to operate other downhole equipment. The tubular to be removed is engaged before the cut and put in tension while the cut is taking place. These and other features of the present invention will be more apparent to those skilled in the art from a review of the detailed description and the associated drawings while understanding that the full scope of the invention is to be determined from the appended claims.

SUMMARY OF THE INVENTION

A cut and pull spear is configured to obtain multiple grips in a tubular to be cut under tension. The slips are set mechanically with the aid of drag blocks to hold a portion of the assembly while a mandrel is manipulated. An annular seal is set in conjunction with the slips to provide well control during the cut. An internal bypass around the seal can be in the open position to allow circulation during the cut. The bypass can be closed to control a well kick with mechanical manipulation as the seal remains set. If the tubular will not release after an initial cut, the spear can be triggered to release and be reset at another location. The mandrel is open to circulation while the slips and seal are set and the cut is being made. Cuttings are filtered before entering the bypass to keep the cuttings out of the blowout preventers.

DETAILED DESCRIPTION OF THE PREFERRED EMBODIMENT

Figure 3:
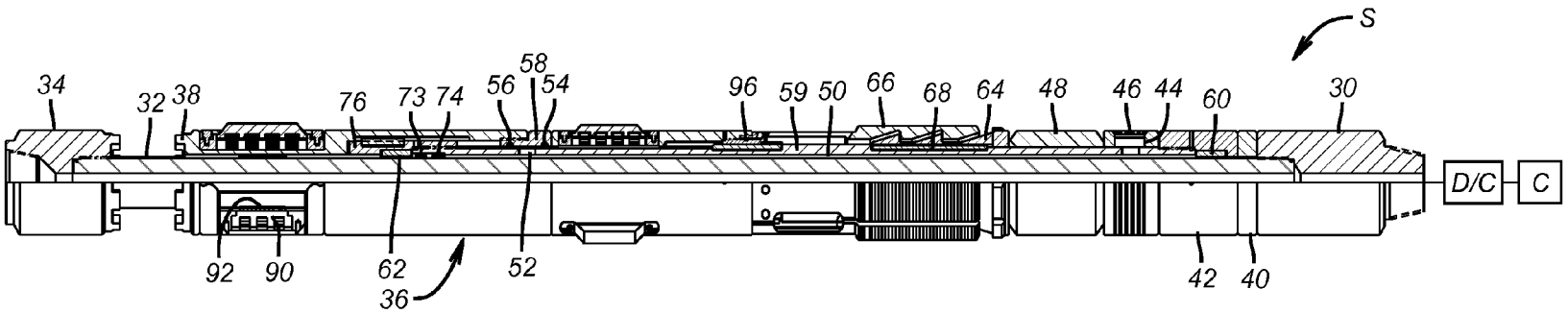
FIG. 3 is the preferred embodiment of the cut and pull spear with the annular seal and the bypass for the seal in the closed position.

Referring to FIG. 3 the spear S has a bottom sub 30 to which the cutter schematically illustrated as C is attached for tandem rotation. A mandrel 32 connects the bottom sub to the drive sub 34. An outer housing 36 extends from castellations 38 at the top end to the bearing 40 at the lower end. Bearing 40 is used because the bottom sub 30 will turn as a casing or tubular (not shown) is cut while sub 42 is stationary. Above the sub 42 are ports 44 covered by preferably a wire wrap screen 46. Other filtration devices for cuttings when the tubular is cut are envisioned. A debris catcher DC can also be located below the bottom sub 30 that channels the return fluid flowing through the cutter C and back toward the surface from the region where the cutter C is operating. A variety of known rotary cutter designs can be used with the potential need to modify them for a flow through design to enable cutting removal flow. Several known debris catcher designs can be used such as those shown in U.S. Pat. Nos. 6,176,311; 6,276,452 ;6,607,031; 7,779,901 and 7,610,957 with or without the seal 48. While the seal 48 is preferably an annular shape that is axially compressed to a sealing position alternative designs with a debris catcher can involve a diverter for the debris laden fluid that either doesn't fully seal or that seals in one direction such as a packer cup. Alternatively a debris catcher with a diverter can be used in conjunction with as seal such as 48 while operating with the bypass 50 in the open position.

Ports 44 lead to an annular space 50 that extends to ports 52 which are shown as closed in FIG. 3 because the o-rings 54 and 56 on sub 58 straddle the ports 52. A support sleeve 59 extends between bearings 60 and 62 and circumscribes the mandrel 32. Support sleeve 59 supports the seal 48 and the cone 64 and the slips 66. A key 68 locks the cone 64 to the sleeve 59. Sleeve 59 does not turn. Slips 66 are preferably segments with multiple drive ramps such as 70 and 72 that engage similarly sloped surfaces on the cone 64 to drive out the slips 66 evenly and distribute the reaction load from them when they are set. Sleeve 59 has chevron seals 73 and 74 near the upper end by bearing 62 to seal against the rotating mandrel 32. End cap 76 is secured to sleeve 59 while providing support to the bearing 62. A key 78 in end cap 76 extends into a longitudinal groove 80 in top sub 82. Top sub 82 is threaded at 84 to sub 58 for tandem axial movement without rotation.

Figure 4:
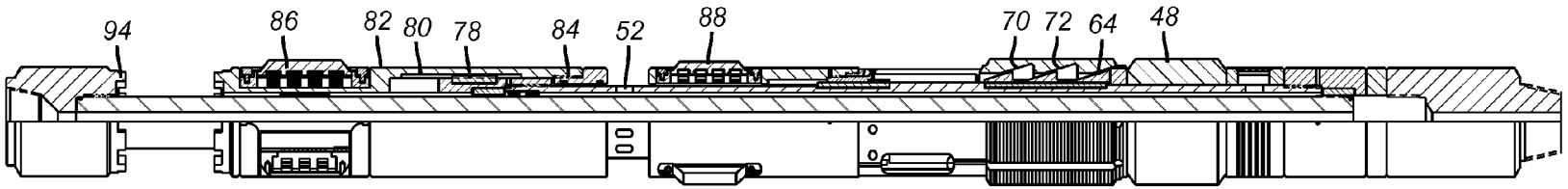
FIG. 4 is the view of FIG. 3 with the bypass for the seal shown in the open position with the slips set.
Figure 5:
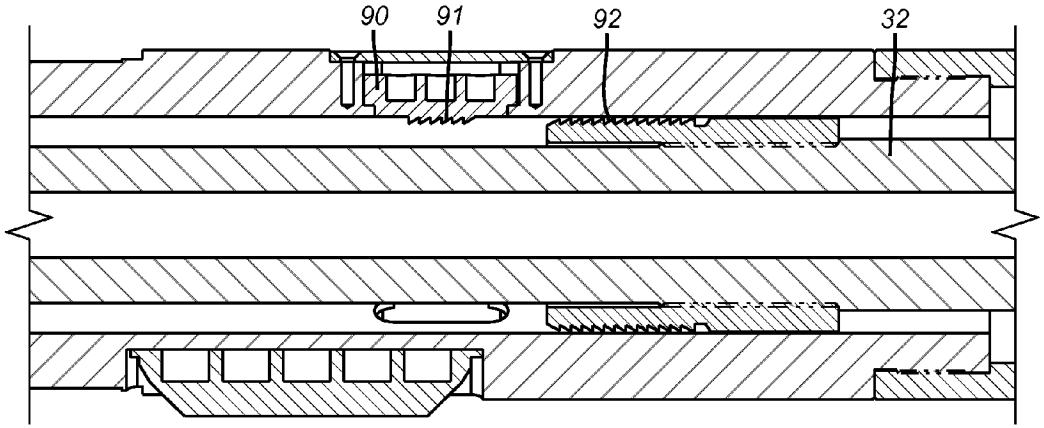
FIG. 5 is a close up view of the mechanism for opening and closing the bypass ports 52 shown closed in FIG. 3 and open in FIG. 4 in the run in position for the tool with ports 52 closed.
Figure 6:
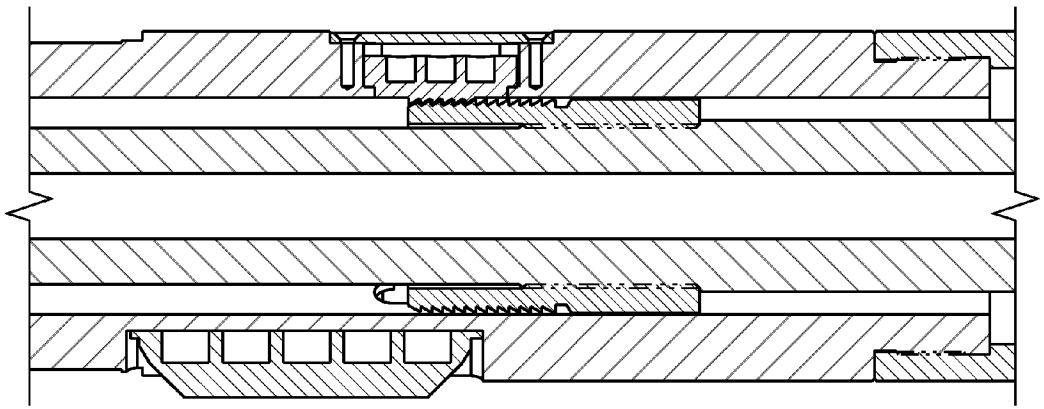
FIG. 6 is the view of FIG. 5 in the set position for the tool and the automatic nut driven up to open the ports 52 by virtue of mandrel rotation.
Figure 7:
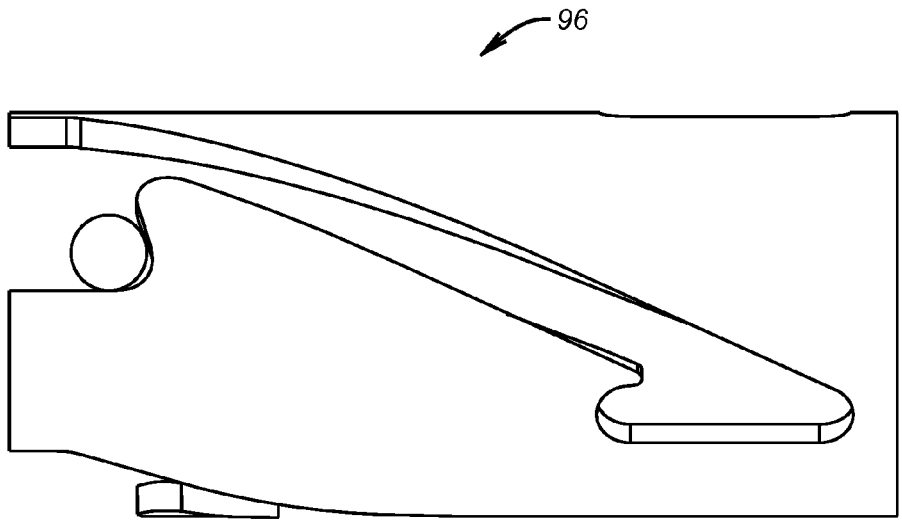
FIG. 7 is a rolled flat view of the i-slot 96 in the run in position.
Figure 8:
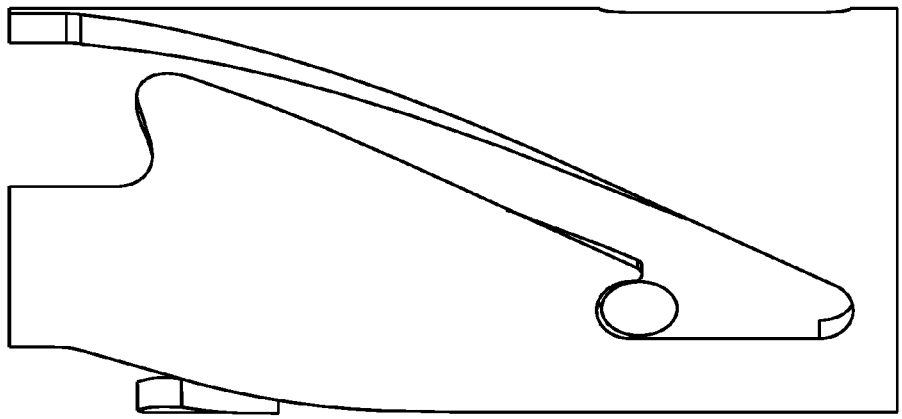
FIG. 8 is the view of FIG. 7 in the set position.

Upper drag block segments 86 and lower drag block segments 88 hold the outer non-rotating assembly fixed against an applied force so that mechanical manipulation of the mandrel 32 can actuate the spear S as will be described below. In between the spaced drag block segments 86 is an automatic nut 90 that is also a series of spaced segments that have a thread pattern 91 facing and selectively engaging with a thread 92 on the mandrel 32. The automatic nut 90 is a ratchet type device so that when the mandrel 32 is moved from the FIG. 5 position the segments of the automatic nut 90 just jump over the thread 92. When the mandrel 32 is rotated after ratcheting the automatic nut 90 into the thread 92, as shown by FIG. 6, the automatic nut 90 and with the top sub 82 and sub 58 being constrained by the key 78 from rotation, the top sub 82 winds up moving axially so that the o-ring seals 54 and 56 no longer straddle ports 52 now shown in the open position in FIG. 4. Simply setting down weight on the mandrel 32 will reclose the ports 52 in the event of a well kick.

In order to set the slips 66 and the seal 48, weight is set down during run in so that the castellations 94 engage the castellations 38 and the drive sub is turned to the right about 40degrees to operate the j-slot 96 in a well-known manner using the support of the drag blocks 86 and 88 also in a well-known manner. These movements enable bringing the cone 64 under the slips 66 to extend them with continued pulling force compressing the seal 48 against the surrounding tubular to be cut. In this position, setting down weight to close the bypass ports 52 will not release the slips 66 because the well-known shape of the j-slot 96 prevents such movement. When ports 52 are open, the automatic nut 90 is no longer affected by mandrel 32 rotation to the right. As stated before, the ports 52 are closed with setting down weight but the slips 66 and the seal 48 remain set even with the weight being set down to close the ports 52 in the event of a well kick because of the well-known shape of a j-slot such as 96. Eventually the slips 66 and seal 48 can be released by axial opposed movements of the mandrel 32 caused by physical force or pressure cycles that further reconfigures the combination lock/j-slot mechanism 96 in a well-known manner of registry from one slot to an adjacent slot of different length so that a setting down force will pull the cone 64 out from under the slips 66 while letting the seal 48 grow axially while retracting radially. The spear S can be reset in other locations in the surrounding tubular to be cut any number of times and at any number of locations.

Figure 1:
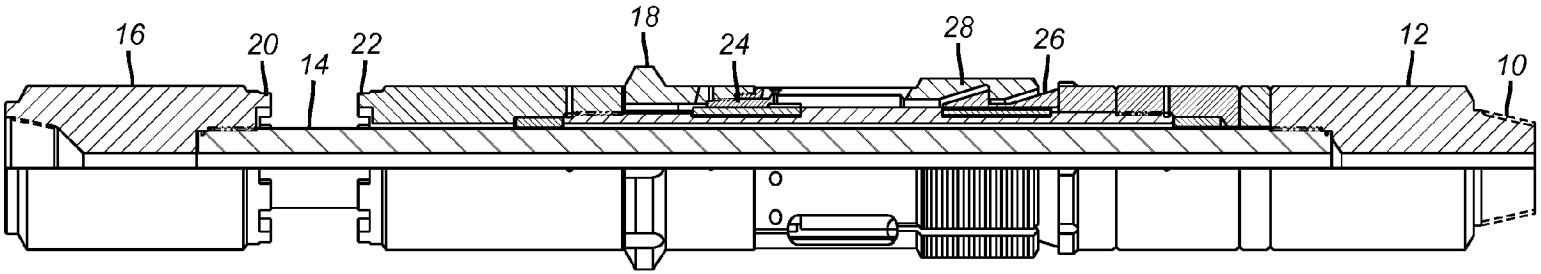
(PRIOR ART) FIG. 1
FIG. 1 is a prior art spear design that uses a stop ring to land on the fish.
Figure 2:
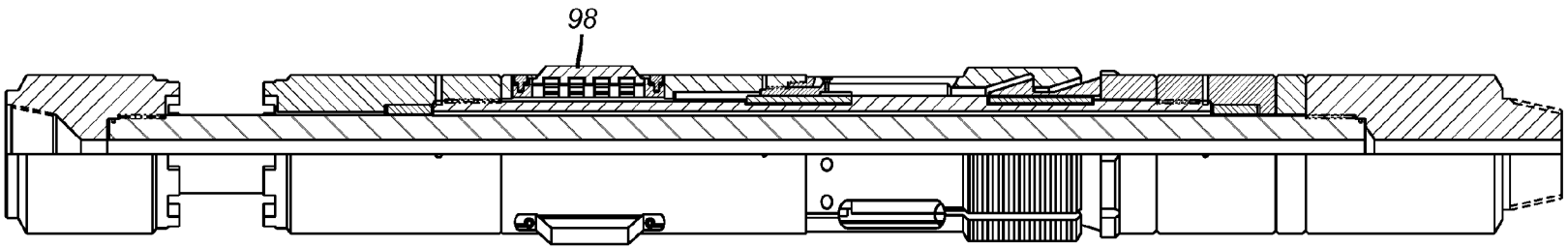
FIG. 2 is a multi-setting spear that is mechanically set to allow multiple cuts in a single trip.

It should be noted that in FIG. 2 the seal 48 is not used and neither is the annular space 50. In this configuration a single row of drag blocks 98 is used. The other operations remain the same.

Those skilled in the art will appreciate that the spear S offers several unique and independent advantages. It allows the ability to set and cut in multiple locations with the tubular to be cut under tension while retaining an ability to circulate through the mandrel 32 to power the cutter C or/and to remove cuttings. The tool has the facility to collect cuttings and prevent them from reaching a blowout preventer where they can do some damage. The cuttings can be retained in the FIGS. 3 and 4 configuration using the screen 46 leading to the ports 44 with the seal 48 set so that the return flow is fully directed to the screen 46. In another embodiment such as FIG. 2 a junk or debris catcher can be incorporated at the lower end that has a flow diverter to direct cuttings into the device where they can be retained and screened and the clean fluid returned to the annular space above the diverter for the trip to the surface. Another advantage is the ability to have the annulus sealed with a bypass for returns as it provides options when the well kicks of closing the bypass quickly while the seal 48 is still actuated. In the preferred embodiment this is done with setting down to close the ports 52. Note that no all jobs will require the bypass 50 around the seal 48 to be open during the cutting.

The above description is illustrative of the preferred embodiment and many modifications may be made by those skilled in the art without departing from the invention whose scope is to be determined from the literal and equivalent scope of the claims below.

We claim:

1. A spear and tubular cutter combination for cutting a tubular from a surface location, comprising:

a mandrel rotatably mounted in an outer assembly for continuous rotation while supporting an operating tubular cutter, said mandrel having a flow passage therethrough;

an anchor mounted to said outer assembly and configured to allow said outer assembly to enter the tubular so that said tubular cutter cuts the tubular with a tensile force on the tubular applied through said mandrel to said outer assembly when said mandrel is held axially stationary that is of a magnitude to at least support the weight of a tubular segment being produced by said tubular cutter;

an annular seal on said outer assembly selectively engaging the tubular when said anchor is moved against the tubular to close off against the tubular when said cutter cuts the tubular, said seal, when engaging the tubular, is disposed on said outer assembly in a manner that allows flow exiting said flow passage of said cutter to selectively reach the surface.

2. The combination of claim 1, wherein:

said outer assembly further comprises a drag assembly to support at least a portion of said outer assembly as said mandrel is moved relative to said outer assembly.

3. The combination of claim 2, wherein:

said outer assembly comprises a cone to actuate said anchor when said cone is advanced with respect to said anchor.

4. The combination of claim 3, wherein:

said anchor comprises at least one slip;

said outer assembly comprises a lock assembly to prevent relative axial movement of said cone with respect to said slip until selectively released.

5. A spear and tubular cutter combination for cutting a tubular from a surface location, comprising:

a mandrel rotatably mounted in an outer assembly, said mandrel supporting a tubular cutter and having a flow passage therethrough;

an anchor mounted to said outer assembly and configured to allow said outer assembly to enter the tubular to cut the tubular with a tensile force on the tubular;

an annular seal on said outer assembly selectively engaging the tubular when said anchor is moved against the tubular to close off against the tubular when said cutter cuts the tubular, said seal, when engaging the tubular, is disposed on said outer assembly in a manner that allows flow exiting said flow passage of said cutter to selectively reach the surface;

said outer assembly further comprises a drag assembly to support at least a portion of said outer assembly as said mandrel is moved relative to said outer assembly;

said outer assembly comprises a cone to actuate said anchor when said cone is advanced with respect to said anchor;

said anchor comprises at least one slip;

said outer assembly comprises a lock assembly to prevent relative axial movement of said cone with respect to said slip until selectively released;

said mandrel selectively engageable to said outer assembly for tandem rotation to defeat said lock, whereupon application of a tensile force to said mandrel said cone moves under said slip to engage said slip to the tubular.

6. The combination of claim 5, wherein:

said lock assembly continues to retain said slip to the tubular upon a removal of said tensile force to said mandrel;

said lock assembly, upon a predetermined number of opposed axial mandrel movements allowing said cone to be moved out from under said slip to allow the spear to be repositioned in the tubular.

7. The combination of claim 1, further comprising:

a debris retention device supported by one of said mandrel and said outer assembly through which fluid delivered through said flow passage to said cutter returns with cuttings retained by said debris retention device.

8. The combination of claim 1, wherein:

said flow passage remains open for fluid flow as said mandrel rotates said tubular cutter;

said anchor is mechanically operated and operable for multiple deployments and releases of said anchor with respect to the tubular in a single trip.

9. The combination of claim 1, further comprising:

a bypass passage around said seal through said outer assembly.

10. The combination of claim 9, further comprising:

said bypass passage comprising a screen at an inlet thereof to exclude cuttings from operation of said cutter.

11. The combination of claim 9, further comprising:

said bypass passage is selectively closeable.

12. The combination of claim 11, further comprising:

said bypass passage is closed with set down weight on said mandrel.

13. A spear and tubular cutter combination for cutting a tubular from a surface location, comprising:

a mandrel rotatably mounted in an outer assembly, said mandrel supporting a tubular cutter and having a flow passage therethrough;

an anchor mounted to said outer assembly and configured to allow said outer assembly to enter the tubular to cut the tubular with a tensile force on the tubular;

an annular seal on said outer assembly selectively engaging the tubular when said anchor is moved against the tubular to close off against the tubular when said cutter cuts the tubular, said seal, when engaging the tubular, is disposed on said outer assembly in a manner that allows flow exiting said flow passage of said cutter to selectively reach the surface;

a bypass passage around said seal through said outer assembly;

said bypass passage is selectively closeable;

said bypass passage is closed with set down weight on said mandrel;

said bypass passage is opened by mandrel rotation to raise a sleeve to uncover at least one outlet port in said bypass passage.

14. The combination of claim 13, further comprising:

said sleeve is raised with mandrel rotation to the left to engage a thread on said mandrel with a nut on said outer assembly, wherein mandrel rotation moves said sleeve axially to uncover said port.

15. A method of cutting and removing a tubular from a subterranean location, comprising:

running into the tubular a cutter mounted on a mandrel of a spear;

deploying an anchor on an outer assembly of said spear to selectively engage a first desired location within the tubular;

pulling tension on the tubular through said anchor with said mandrel axially stationary as said mandrel is continuously rotated to cut the tubular, said tension at least offsetting the weight of a segment of the tubular produced by said cutter;

sealing off an annular space about said outer assembly with a seal around said outer assembly when the tubular is cut;

disposing said seal on said outer assembly in a manner that allows flow exiting a flow passage of said cutter to selectively reach a surface location.

16. The method of claim 15, comprising:

leaving open a flow passage through said mandrel when the tubular is cut by said cutter;

flowing fluid through said passage to remove cuttings as the tubular is cut.

17. The method of claim 15, comprising:

configuring said anchor for redeployment at at least one other desired location in the tubular in the same trip so that if the cut tubular will not release after an initial cut another cut is made in a different location redeploying said anchor at a second location in the tubular for a second cut.

18. The method of claim 16, comprising:

removing cuttings from said flowing fluid as it returns from the cut location.

19. The method of claim 15, comprising:

setting said anchor mechanically.

20. The method of claim 15, comprising:

providing a selectively open bypass around said seal when the tubular is being cut.

21. The method of claim 20, comprising:

screening cuttings to retain at least some of the cuttings out of said bypass.

22. The method of claim 20, comprising:

closing said bypass in event of a well kick by setting down weight on said mandrel.

23. The method of claim 20, comprising:

maintaining said seal and anchor set against the tubular as said bypass is opened or closed.

* * * * *